US010042373B2

(12) United States Patent
Moughabghab

(10) Patent No.: US 10,042,373 B2
(45) Date of Patent: Aug. 7, 2018

(54) HIGH UNITY GAIN BANDWIDTH VOLTAGE REGULATION FOR INTEGRATED CIRCUITS

(71) Applicant: Entropic Communications LLC, Carlsbad, CA (US)

(72) Inventor: Raed Moughabghab, Carlsbad, CA (US)

(73) Assignee: Entropic Communications, LLC., Carlsbad, CA (US)

( * ) Notice: Subject to any disclaimer, the term of this patent is extended or adjusted under 35 U.S.C. 154(b) by 0 days.

(21) Appl. No.: 15/449,485

(22) Filed: Mar. 3, 2017

(65) Prior Publication Data

US 2017/0177015 A1 Jun. 22, 2017

Related U.S. Application Data

(63) Continuation of application No. 13/956,272, filed on Jul. 31, 2013, now Pat. No. 9,588,533.

(60) Provisional application No. 61/678,034, filed on Jul. 31, 2012.

(51) Int. Cl.

| | |
|---|---|
| ***G05F 1/63*** | (2006.01) |
| ***G05F 1/575*** | (2006.01) |
| *G05F 1/46* | (2006.01) |
| *G05F 3/24* | (2006.01) |

(52) U.S. Cl.

CPC ..... *G05F 1/575* (2013.01); *G05F 1/461* (2013.01); *G05F 1/63* (2013.01); *G05F 3/24* (2013.01)

(58) Field of Classification Search

CPC ... G05F 1/10; G05F 1/163; G05F 1/46; G05F 1/461; G05F 1/467; G05F 1/56; G05F 1/575; G05F 3/08; G05F 3/185; G05F 3/18; G05F 3/20; G05F 3/24; G05F 3/30

See application file for complete search history.

(56) References Cited

U.S. PATENT DOCUMENTS

| | | | | |
|---|---|---|---|---|
| 4,468,629 | A * | 8/1984 | Choma, Jr. | H03F 3/45071 330/260 |
| 6,566,949 | B1 | 5/2003 | Park | |
| 6,580,325 | B1 * | 6/2003 | Aude | H03F 3/45192 330/260 |
| 2006/0145762 | A1 * | 7/2006 | Leete | H03F 3/195 330/254 |

(Continued)

*Primary Examiner* — Gustavo Rosario Benitez

(74) *Attorney, Agent, or Firm* — McAndrews, Held & Malloy

(57) ABSTRACT

An integrated circuit voltage regulator includes a transconductor first stage; and a negative impedance cancellation stage, where the negative impedance cancellation stage comprises cross-coupled transistors at outputs of said transconductor first stage, and resistors in the transconductor first stage and the negative impedance cancellation stage introduce zeros in a transfer function, compensating for parasitic poles. The resistors may compensate for parasitic capacitance inherent in transistors. Load transistors may be coupled to outputs of the transconductance first stage. The voltage regulator may be implemented in a Complementary Metal-Oxide-Semiconductor (CMOS) structure, which may be a system-on-chip integrated circuit. The voltage regulator may provide immunity to power supply noise. The negative impedance cancellation stage may include differential input transistors coupled to the cross-coupled transistors.

19 Claims, 5 Drawing Sheets

(56) References Cited

U.S. PATENT DOCUMENTS

| | | | | |
|---|---|---|---|---|
| 2007/0040603 | A1* | 2/2007 | Shor | G05F 1/565 327/543 |
| 2007/0216483 | A1* | 9/2007 | Bhattacharya | H03F 1/0205 330/257 |
| 2008/0036537 | A1* | 2/2008 | Syed | H03F 1/26 330/253 |
| 2010/0182080 | A1 | 7/2010 | Mak | |
| 2010/0214024 | A1* | 8/2010 | Jones | H03F 1/0205 330/310 |
| 2010/0327887 | A1 | 12/2010 | Denison | |
| 2010/0329158 | A1* | 12/2010 | Sengupta | H03F 1/3211 370/278 |

* cited by examiner

HIGH UNITY GAIN BANDWIDTH VOLTAGE REGULATION FOR INTEGRATED CIRCUITS

CLAIM OF PRIORITY

The present Application for Patent is a continuation of application Ser. No. 13/956,272 filed on Jul. 31, 2013, which claims priority to Provisional Application No. 61/678,034 entitled "Advanced Voltage Regulation for Integrated Circuits" filed Jul. 31, 2012, and assigned to the assignee hereof and hereby expressly incorporated by reference herein.

BACKGROUND

Field

The present invention relates generally to voltage regulation for Integrated Circuit technology, and more specifically to efficient noise immune voltage regulation in Integrated Circuits requiring.

Background

A voltage regulator is designed to automatically maintain a constant voltage level. A voltage regulator may be a simple "feed-forward" design or may include negative feedback control loops. It may use an electromechanical mechanism or electronic components. Depending on the design, it may be used to regulate one or more Alternating Current (AC) or Direct Current (DC) voltages. Electronic voltage regulators are found in devices such as computer power supplies where they stabilize DC voltages used by the processor and other elements. The stability of the output voltage can be significantly increased by using an operational amplifier. The operational amplifier drives its transistor with more current if the voltage at its inverting input drops below the output of the voltage reference at a non-inverting input. A voltage divider allows selection of an arbitrary output voltage.

Traditional apparatus and methods for electronic operational amplifier voltage regulation in Integrated Circuits (ICs) typically require physical separation between analog and digital circuit blocks as well as individual external bypass capacitors for each voltage regulation node requiring an individual external pin interface. These external bypass capacitors at the output of the integrators quiet the regulated voltage node by filtering noise from the power supply signal line.

A linear power line regulator may also step a higher voltage down to a lower voltage used as a power supply for specific digital hardware blocks, traditionally in conjunction with a an external capacitor to filter environmental noise. However, an external capacitor for each internal voltage regulation node necessitates an external pin on the Integrated Circuit package for each internal regulation node of the IC, generating size and complexity issues as well as additional manufacturing costs. For example, in implementations having multiple digital and analog functional blocks requiring ten internal regulation nodes, an additional ten external pins and associated capacitors must be added to the IC package. Due to noise in the environment, many voltage regulators are inefficiently required in order to quiet the analog blocks, requiring more and more regulators and their associated external pins and capacitors coupled to ground.

Unfortunately, such external bypass capacitors create inductances between the internal node, the capacitor and the Printed Circuit Board (PCB) substrate generating concomitant parasitic signals that impair performance of high frequency circuits. The external capacitor effectively filters noise and parasitics at low frequencies but not at high frequencies because those components that are introduced through the IC package and the PCB substrate inherently reduce the efficiency of the capacitor. Above certain frequencies, the quality factor is reduced because of the components in series with the capacitor, which can no longer effectively filter noise and parasitic signals from the environment. In other words, an ideal capacitor with no parasitic signals around it has a linear transfer function. It attenuates at a frequency N. Attenuation increases linearly with increase in frequency. If no additional components are introduced around the capacitor, the transfer function remains linear. Adding resistors or other components in series with the capacitor causes the transfer function to become non-linear as it reaches a threshold operational frequency, flattening out the transfer function and degrading the ability of the capacitor to filter parasitic noise. At higher frequencies, the capacitor loses its efficiency and no longer acts as a filter. Many of the functional hardware blocks beneficially protected by voltage regulation are operating at high frequencies, traditionally forcing physical IC separation of analog and digital blocks, separate ground planes and implementation of External Power Management Integrated Circuit (PMIC) devices.

Complexity and manufacturing costs drive an ever increasing need for integration of functionality and analog and digital hardware blocks in ICs, which requires an internal solution capable of guaranteeing enough noise immunity for high frequency analog sensitive blocks to reside within an IC device without being contaminated by noise from other hardware blocks. Inversely, noise generated by these other blocks must be contained within those blocks.

There is therefore a need in the art for noise immune voltage regulation at high frequencies suitable for SOC implementation without the need for individual external bypass capacitors, their associated performance degradation, and multitude of external interface pins on the IC package, while also providing enough gain for operation.

SUMMARY

Embodiments disclosed herein address the above stated needs by providing a method and apparatus for High Unity Gain BandWidth (HUGBW) noise immune voltage regulation for Integrated Circuits without the need for block separation or individual external bypass capacitors and pin interfaces at each voltage regulation node.

DETAILED DESCRIPTION

The word "exemplary" is used herein to mean "serving as an example, instance, or illustration." Any embodiment described herein as "exemplary" is not necessarily to be construed as preferred or advantageous over other embodiments.

The term "High Unity Gain Band Width (HUGBW) is used herein to mean infinite gain at high frequency operation in the hundreds of Mega Hertz range, wherein the gain can be selected independently of the bandwidth and wherein an operational amplifier voltage regulation gain becomes one at a very high frequency in the hundreds of Mega Hertz range.

Figure 1:
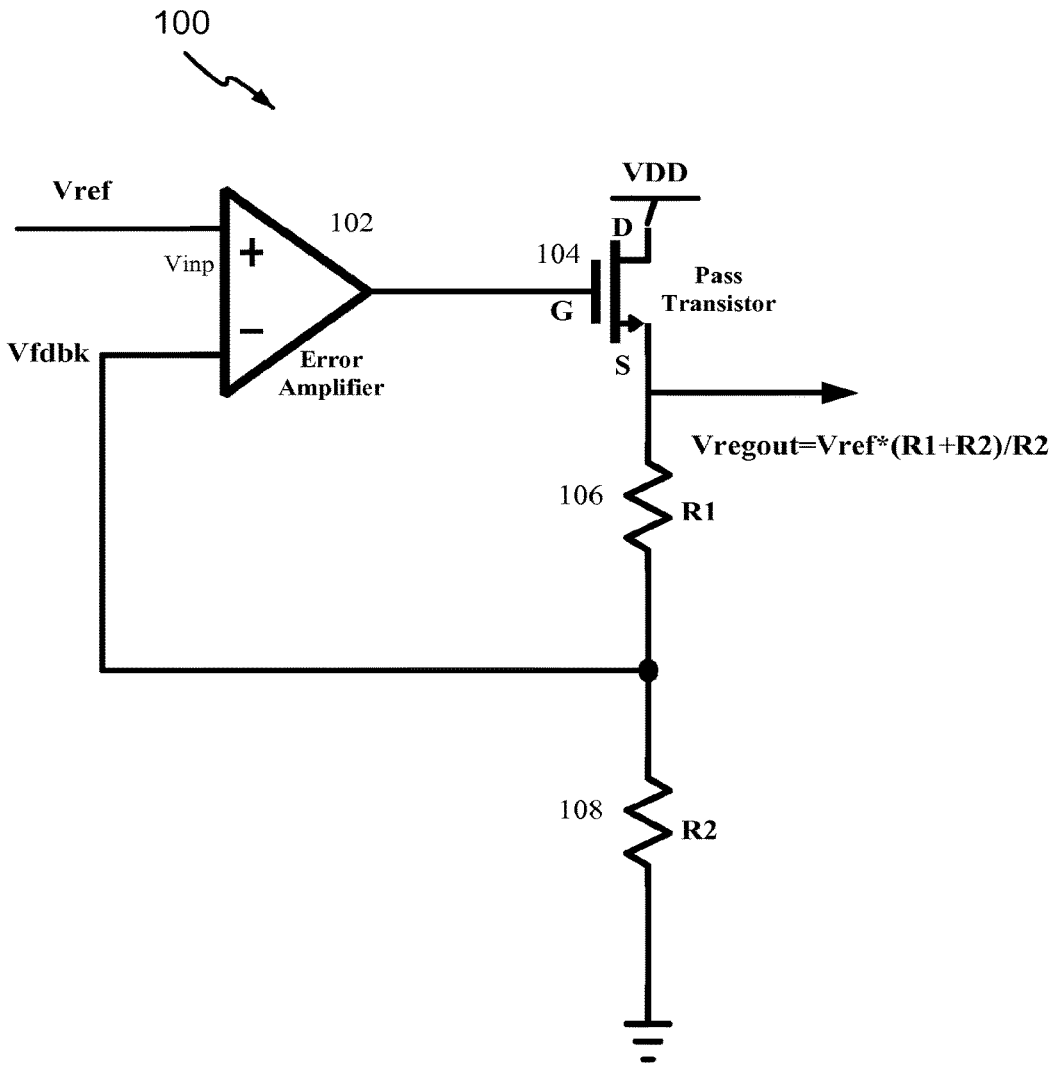
FIG. 1 (PRIOR ART)
FIG. 1 is a high level overview block diagram illustrating traditional operational amplifier voltage regulation.

FIG. 1 is a high level overview block diagram illustrating traditional operational amplifier voltage regulation 100 having an error amplifier followed by a pass transistor. A fixed reference voltage (Vref) is applied to a positive input (Vinp) of error amplifier 102. The fixed reference voltage (Vref) is generated by a bandgap circuitry that provides a fixed voltage constant across temperature and power supply voltage variation. An exemplary fixed reference voltage (Vref) may have a value between 0.3 Volts (V) and 1.5 V. The output of the error amplifier 102 is applied to the Gate (G) of a pass transistor 104 having its Drain node (D) coupled to a power supply voltage, Vdd. The Source (S) output of the pass transistor 104 is applied to a negative input of the error amplifier 102 through a feedback resistor R1 106. Feedback resistor R1 106 is also coupled to ground through grounding resistor R2 (108).

Thus, the regulated output voltage (Vregout) at the Source node (S) of the pass transistor 104 is equal to the fixed reference voltage (Vref) multiplied by R1 added to R2 and divided by R2. This unfiltered output (Vregout) has a reduced error in voltage between the positive (Vref) and negative input (Vfdbk) voltages of the error amplifier 102. In other words, a voltage offset error of a very few milliVolts (mV) is maintained at the output (S) of the pass transistor 104. The feedback voltage (Vfdbk) applied to the negative input of the error amplifier is approximately equal to the fixed reference voltage (vref). Due to the high DC gain of the error amplifier, only a few mVs of offset will appear at the input of the error amplifier 102, i.e. Vfdbk=Vref+Δoffset. The internal operation of the error amplifier 102 is detailed in FIG. 2.

Figure 2:
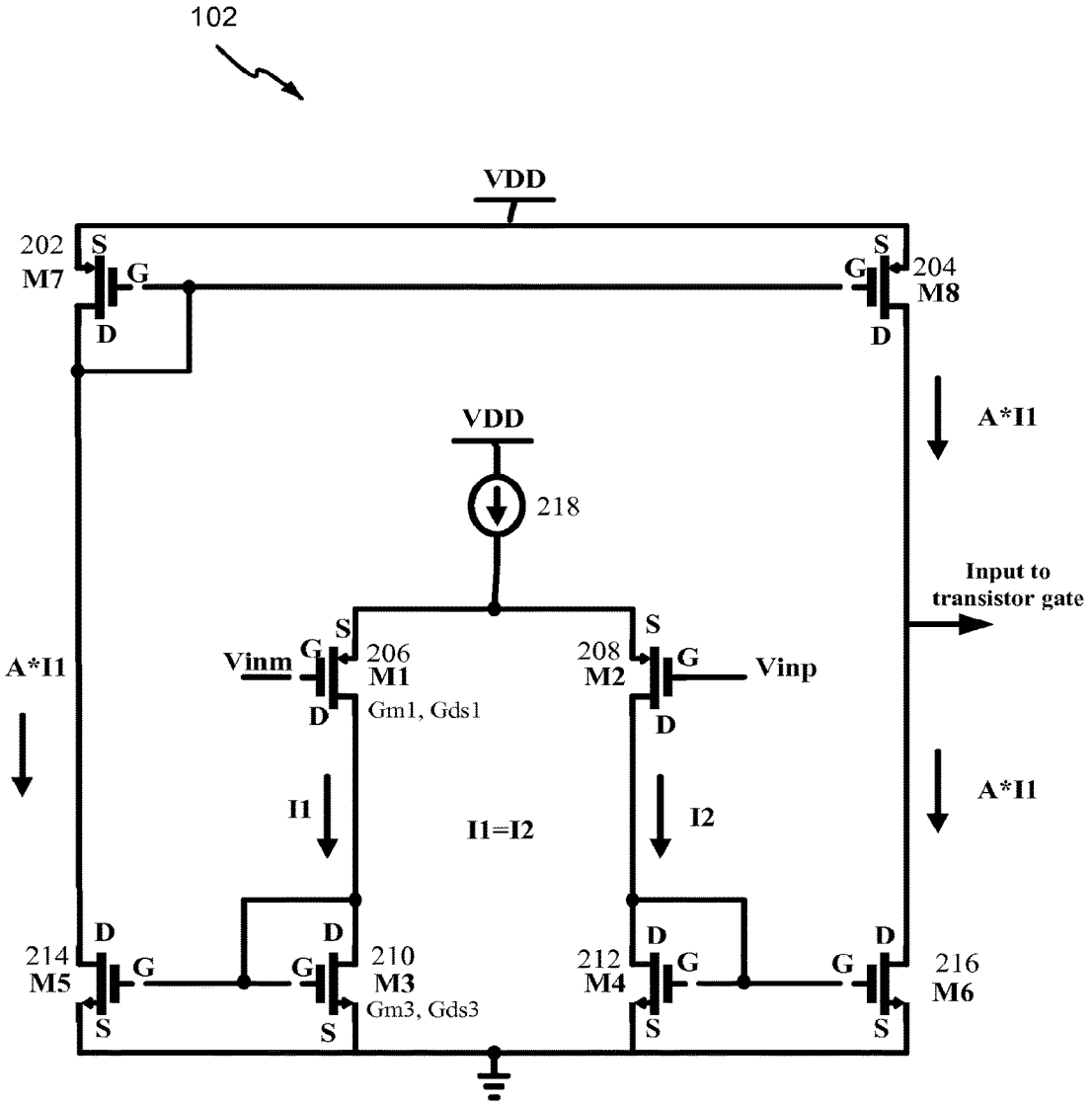
FIG. 2 (PRIOR ART)
FIG. 2 is a detailed circuit diagram of a traditional error amplifier.

FIG. 2 is a detailed internal circuit diagram of a traditional error amplifier 102. Power supply voltage Vdd is applied to the Source (S) inputs of transistor pair M7 202 and M8 204, through bias current 218 needed for biasing differential pair M1 206 and M2 208 and load transistor pair M3 210 and M4 212. The Gates (G) of differential pair M1 206 and M2 208 have negative input supplied from the feedback resistor of the regulated output voltage (R1, FIG. 1) and positive input voltage Vinp supplied by Vref respectively. Bias current 218 flows from the power supply (Vdd) through the differential pair M1 206 and M2 208 to the load transistors M3 210 and M4 212 as 11 and 12 respectively. This current value is copied to transistors M5 214 and M6 216 and then to M7 202 and M8 204, equalizing the positive and negative inputs in the top level as described in FIG. 1 with a DC gain of integer value equal to A multiplied by Gm1 and then divided by the addition of Gm3, Gds 1 and Gds3 where A is multiplication factor of the current 11 implemented through a factor equal to A between M4 transistor size and M6 transistor size, Gm1 is transistor M1 transconductance, Gm3 is transistor M3 transconductance, Gds1 is transistor M1 conductance and Gds3 is transistor M3 conductance. The Unity gain BandWidth of the error amplifier detailed in FIG. 2 is UGBW=A*Gm1/(2*H*Cload), where Cload is the Load Capacitor present on the input to transistor gate node.

In order to increase the UGBW of this error amplifier, the channel length of transistor M3 & M4 needs to be reduced. When the channel length is reduced, the DC gain of the error amplifier reduces because both Gm3 and Gds3 increase, thus losing its voltage regulation accuracy. When channel length of M3/M4 reduces, the UGBW increases but remains limited by the parasitic poles created by transistors M3/4 and the load capacitance on their gate G. This will cause the error amplifier to have a relatively small phase margin, degrading its stability and thus having a high output ripple value generated by the error amplifier low phase margin and the current load provided by the regulator to the circuitries.

Thus, traditional voltage regulation having inherently low DC Gain, limited bandwidth and degraded voltage regulation cannot provide noise immune voltage regulation at high frequencies suitable for System On Chip (SOC) implementation without the need for individual external bypass capacitors, their associated performance degradation, and multitude of external interface pins on the IC package.

Figure 3:
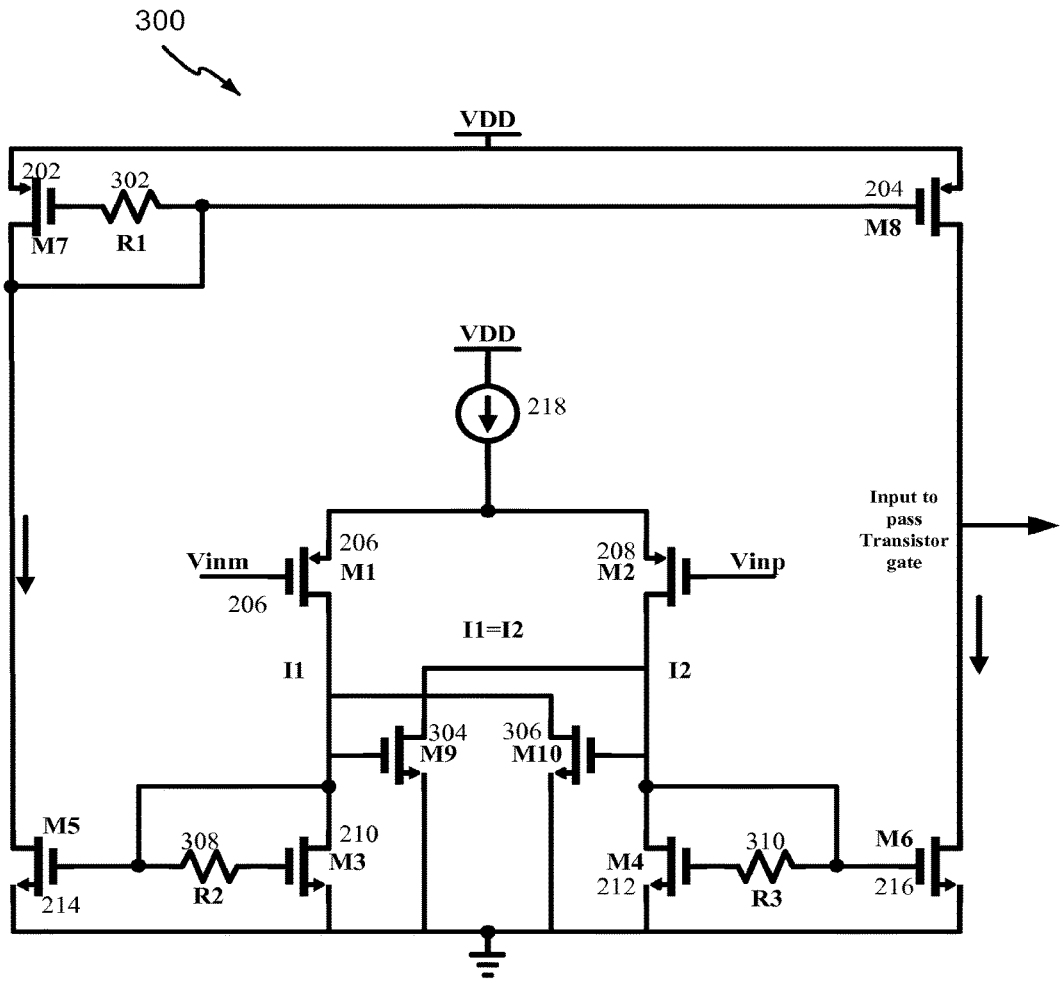
FIG. 3 is an exemplary circuit diagram illustrating enhanced DC gain and bandwidth in a High Unity Gain BandWidth integrated circuit voltage regulator.
Figure 4:
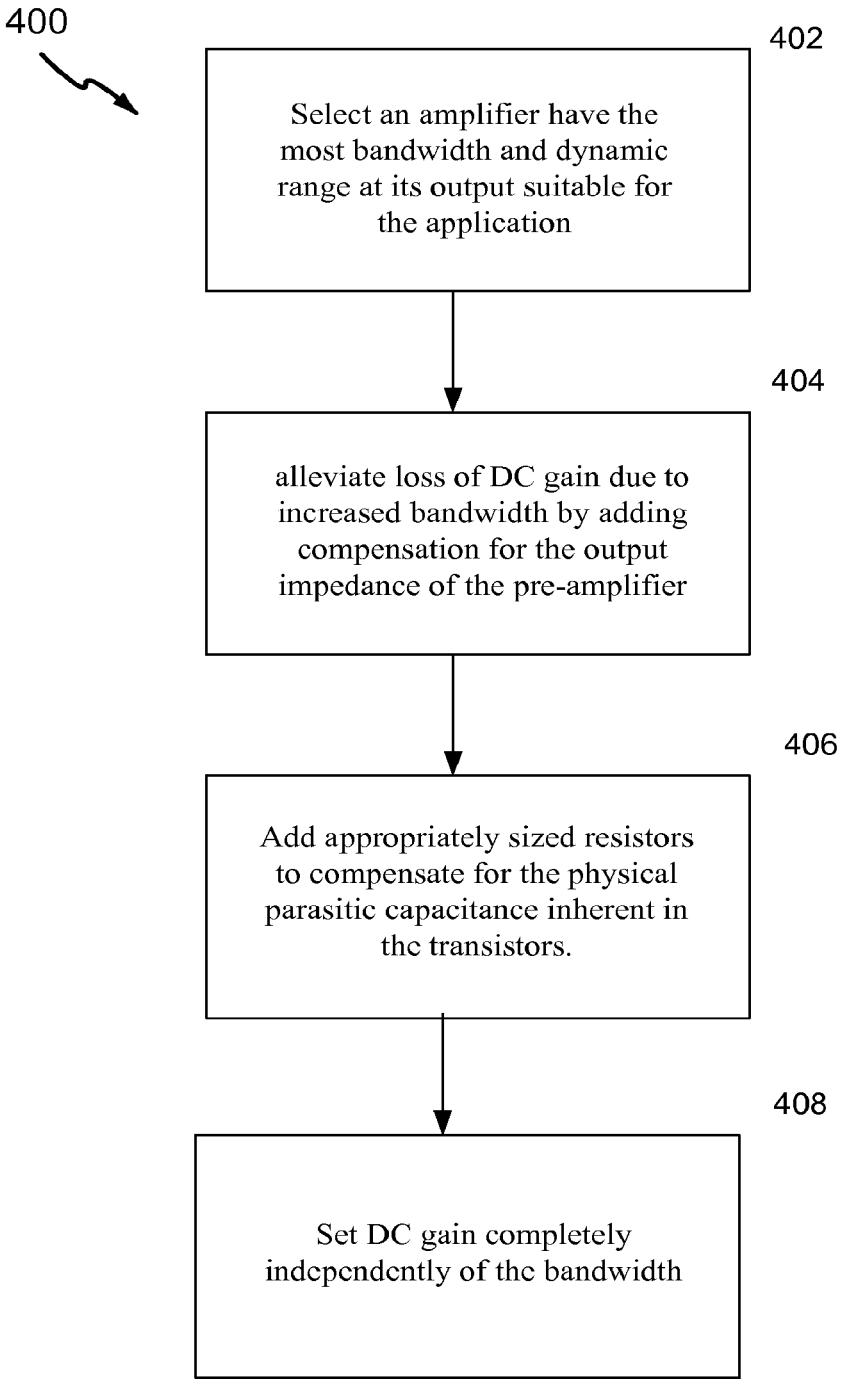
FIG. 4 is an exemplary flow diagram illustrating a method for implementing High Unity Gain BandWidth voltage regulation for integrated circuits.
Figure 5:
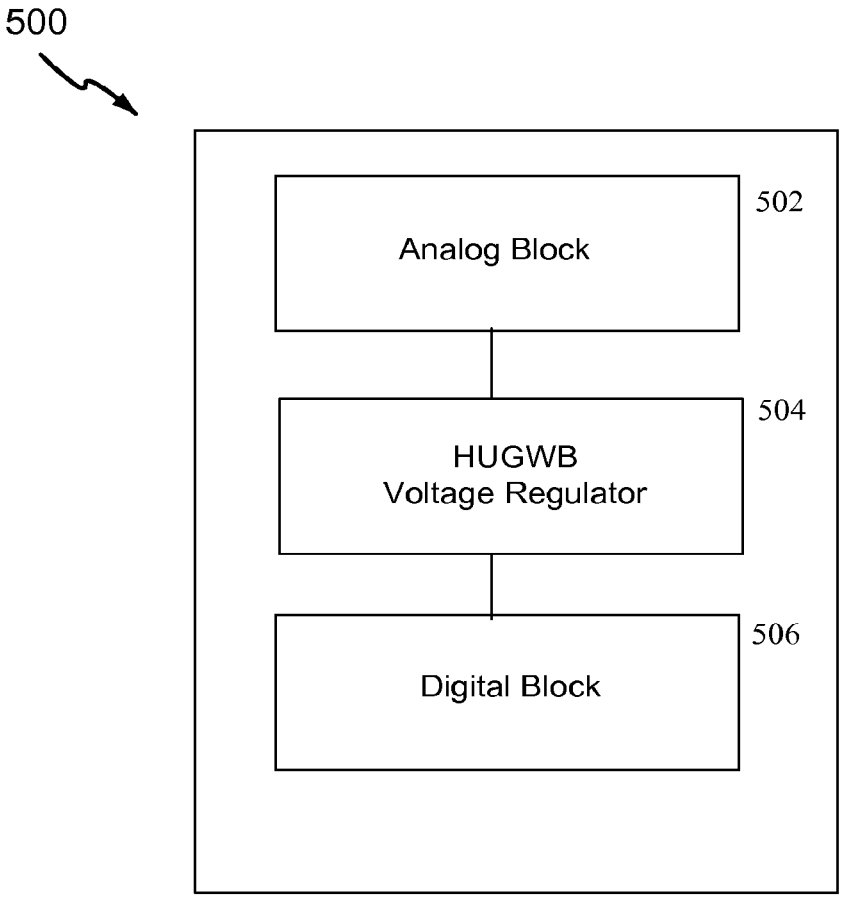
FIG. 5 is a high level overview block diagram of a System on Chip Integrated Circuit having High Unity Gain BandWidth voltage regulation.

FIGS. 3-5 disclose an Integrated Circuit having a simple Complementary Metal-Oxide Semiconductor (CMOS) structure to implement a High Unity Gain BandWidth (HUGBW) voltage regulator. This method of HUGBW voltage regulation provides for low voltage ripple at the output of the regulator in high frequency ranges, advantageously eliminating the need for external bypass capacitors and interface pins traditionally utilized to reduce voltage regulation ripple. The HUGBW voltage regulator also provides immunity to power supply noise for noise sensitive circuitries by isolating radiation from the power supply environment, thus permitting System On Chip (SOC) integration of noise sensitive digital circuit blocks with analog circuit blocks having intolerable levels of environment noise without multiple external pins and bypass capacitors.

In order to achieve a highly amplified unity gain DC Current while maintaining sufficient bandwidth for high frequencies, the novel structure implements a current based transconductor first stage followed by a negative impedance cancellation second stage. The current based transconductor first stage allows for high dynamic voltage range at the input of the follower stage to enable the use of this voltage regulator in an extended range of current draw. By adding a negative impedance generation inserted in the input stage, the DC gain can be adjusted to the accuracy level required by the application.

In order to achieve this High Unity Gain BandWidth, the impact of parasitic poles must be reduced. Theoretically, the only dominant pole is at the regulator output node, but realistically the internal circuitry also limits the stability. By adding appropriately sized resistors at the Gate terminals of Diode-Like connected transistors, the parasitic poles are mitigated. Compensating for these parasitic poles by creating zeros in the same frequency location through the addition of resistors in conjunction with the use of a negative resistor method to increase the DC Gain allows for very HUGBW implementation while preserving the absolute voltage accuracy of the resulting regulated voltage.

FIG. 3 is an exemplary circuit diagram illustrating enhanced DC gain and high bandwidth in a HUGBW integrated circuit voltage regulator 300, detailing novel improvements to traditional voltage regulation shown in FIG. 2. Transistors M9 304 and M10 306 create a cross-coupled pair having a cancelling negative impedance. This negative impedance boosts the DC gain of the regulator to improve the accuracy of the regulated output voltage and permits gain adjustment independent of bandwidth.

Parasitic poles introduced by the inherent capacitance of transistor pairs M3 210/M5 214, M4 212/M6 216 and M7 202/M8 204 create a phase shift that causes the amplifier to become unstable at high frequencies. In traditional voltage regulation, this effect pushes a design limit of the UGBW by increasing the capacitance load in order to stabilize the amplifier. Novel resistors R1 (302), R2 (308) and R3 (310) introduce zeros in the transfer function that compensates for the parasitic poles and allows for a UGBW extension.

FIG. 4 is an exemplary flow diagram illustrating a method for implementing High Unity Gain BandWidth voltage regulation (400). Increasing bandwidth to support high frequencies requires increasing the input current to the input differential transistor pairs and input pre-amplifier. However, increasing input current to increase bandwidth causes the DC gain of the preamplifier to drop drastically whereby the regulated voltage loses its accuracy. Cancellation of the output impedance of the pre-stage is then performed so that the DC gain can be increased. Adjusting output impedance cancellation allows increased current to enhance bandwidth while maintaining DC gain and precise voltage regulation. Applying appropriately selected resistors to the gates of the transistors compensates for the inherent parasitic capacitance of those transistors permitting increased bandwidth that is no longer limited by the parasitics of other components.

In step (402), an amplifier with the most bandwidth and dynamic range at its output is selected. Control flow proceeds to step (404).

In step (404), loss of DC gain due to increased bandwidth is alleviated by adding compensation for the output impedance of the pre-amplifier. Control flow proceeds to step 406.

In step (406), appropriately sized resistors are added to compensate for the physical parasitic capacitance inherent in the transistors. By cancelling the inherent parasitic capacitance, the bandwidth can be increased to a desired level beyond any physical limitations of the transistors.

In step 408, the DC gain is set completely independently of the bandwidth.

FIG. 5 is a high level overview block diagram of a System on Chip Integrated Circuit having High Unity Gain BandWidth voltage regulation (500). SOC (500) comprises one or more noise sensitive digital circuit blocks 506 and one or more analog circuit block introducing noise (502) coupled to a HUGBW voltage regulator, wherein DC gain is set completely independently of the bandwidth.

Those of skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

In one or more exemplary embodiments, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A voltage regulator comprising:

a transconductor first stage with load transistors; and a negative impedance cancellation stage, wherein:

said negative impedance cancellation stage comprises cross-coupled transistors at outputs of said transconductor first stage; and resistors in said transconductor first stage and said negative impedance cancellation stage introduce zeros in a transfer function, compensating for parasitic poles:

drain terminals of the load transistors are coupled to gate terminals of the load transistors via the resistors; and the resistors couple the gate terminals of the load transistors to gate terminals of current mirror transistors that mirror current flowing through the load transistors.

2. The voltage regulator of claim 1, wherein said resistors compensate for parasitic capacitance inherent in transistors.

3. The voltage regulator of claim 1, comprising load transistors coupled to outputs of said transconductance first stage.

4. The voltage regulator of claim 1, wherein the voltage regulator is implemented in a Complementary Metal-Oxide-Semiconductor (CMOS) structure.

5. The voltage regulator of claim 4, wherein the CMOS structure comprises a system-on-chip integrated circuit.

6. The voltage regulator of claim 1, wherein the voltage regulator provides immunity to power supply noise.

7. The voltage regulator of claim 1, wherein the negative impedance cancellation stage comprises differential input transistors coupled to the cross-coupled transistors.

8. A method for implementing a voltage regulator comprising:

alleviating loss of Direct Current (DC) gain of an amplifier in said voltage regulator due to increased bandwidth by adding negative compensation for an output impedance of the amplifier;

adding resistors to compensate for physical parasitic capacitance inherent in the transistors in the amplifier; and setting a DC gain independently of the bandwidth; wherein:

said amplifier comprises a differential input stage;

said negative compensation comprises cross-coupled transistors at outputs of said differential input stage; and said resistors introduce zeros in a transfer function, compensating for parasitic poles.

9. The method of claim 8, wherein the voltage regulator is implemented in a Complementary Metal-Oxide-Semiconductor (CMOS) structure.

10. The method of claim 9, wherein the CMOS structure comprises a system-on-chip integrated circuit.

11. The method of claim 8, wherein the voltage regulator provides immunity to power supply noise.

12. A voltage regulator comprising:

a pass transistor having an input and an output;

an error amplifier having first and second inputs, the first input for receiving a reference voltage to be regulated, and an output coupled to the input of the pass transistor, wherein the error amplifier comprises:

differential input transistors at the first and second inputs;

transistors cross-coupled to outputs of the differential input transistors; and load transistors at the outputs of the differential input transistors, said load transistors having resistors coupled in series to inputs of the load transistors, wherein the resistors introduce zeros in a transfer function of the error amplifier, compensating for parasitic poles.

13. The voltage regulator of claim 12, wherein the pass transistor, differential input transistors, cross-coupled transistors, and load transistors comprise metal-oxide-semiconductor (MOS) transistors.

14. The voltage regulator of claim 12, wherein drain terminals of the load transistors are coupled to gate terminals of the load transistors via the resistors.

15. The voltage regulator of claim 14, wherein the resistors couple the gate terminals of the load transistors to gate terminals of current mirror transistors that mirror current flowing through the load transistors.

16. The voltage regulator of claim 15, wherein an output terminal of a first of the current mirror transistors comprises the output of the error amplifier.

17. The voltage regulator of claim 12, wherein an output terminal of a second of the current mirror transistors is coupled to a transistor with a third resistor coupled to its gate terminal.

18. The voltage regulator of claim 12, wherein the voltage regulator is implemented in a Complementary Metal-Oxide-Semiconductor (CMOS) structure.

19. The voltage regulator of claim 18, wherein the CMOS structure comprises a system-on-chip integrated circuit.

* * * * *